US009324544B2

(12) United States Patent
Rather

(10) Patent No.: US 9,324,544 B2
(45) Date of Patent: Apr. 26, 2016

(54) SATURATION CORRECTION FOR ION SIGNALS IN TIME-OF-FLIGHT MASS SPECTROMETERS

(71) Applicant: Bruker Daltonik GmbH, Bremen (DE)

(72) Inventor: Oliver Rather, Lilienthal (DE)

(73) Assignee: Bruker Daltonik GmbH, Bremen (DE)

( * ) Notice: Subject to any disclaimer, the term of this patent is extended or adjusted under 35 U.S.C. 154(b) by 153 days.

(21) Appl. No.: 13/786,001

(22) Filed: Mar. 5, 2013

(65) Prior Publication Data

US 2013/0181123 A1 Jul. 18, 2013

Related U.S. Application Data

(63) Continuation of application No. 13/049,939, filed on Mar. 17, 2011.

(30) Foreign Application Priority Data

Mar. 19, 2010 (DE) ..... 10 2010 011 974

(51) Int. Cl.
*H01J 49/40* (2006.01)
*H01J 49/00* (2006.01)

(52) U.S. Cl.
CPC ..... *H01J 49/0036* (2013.01); *H01J 49/40* (2013.01)

(58) Field of Classification Search
CPC ..... H01J 49/025; H01J 49/40; H01J 49/0036
USPC ..... 250/287, 282; 702/85
See application file for complete search history.

(56) References Cited

U.S. PATENT DOCUMENTS

| | | | | |
|---|---|---|---|---|
| 6,646,252 | B1 * | 11/2003 | Gonin | 250/287 |
| 6,747,271 | B2 | 6/2004 | Gonin et al. | |
| 6,812,454 | B2 | 11/2004 | Gonin | |
| 6,870,156 | B2 | 3/2005 | Rather | |
| 6,909,090 | B2 | 6/2005 | Gonin et al. | |
| 7,145,134 | B2 | 12/2006 | Gonin et al. | |
| 7,291,834 | B2 | 11/2007 | Gonin et al. | |
| 2003/0111597 | A1 | 6/2003 | Gonin et al. | |
| 2004/0046117 | A1 | 3/2004 | Gonin et al. | |
| 2004/0084613 | A1 | 5/2004 | Bateman et al. | |
| 2004/0211895 | A1 | 10/2004 | Green et al. | |
| 2004/0217275 | A1 | 11/2004 | Gonin et al. | |
| 2005/0086017 | A1 | 4/2005 | Wang | |
| 2007/0018113 | A1 | 1/2007 | Gonin et al. | |
| 2009/0206247 | A1 | 8/2009 | Holle | |
| 2010/0213361 | A1 | 8/2010 | Green et al. | |

FOREIGN PATENT DOCUMENTS

| | | | |
|---|---|---|---|
| WO | 2004006159 | 1/2004 | |
| WO | WO 2008142418 A2 * | 11/2008 | 250/282 |

* cited by examiner

*Primary Examiner* — Jack Berman
*Assistant Examiner* — Kevin Chung
(74) *Attorney, Agent, or Firm* — O'Shea Getz O.C.

(57) ABSTRACT

The invention relates to time-of-flight mass spectrometers in which individual time-of-flight spectra are measured by detection systems with limited dynamic measurement range and are summed to sum spectra. The invention proposes a method to increase the dynamic range of measurement of the spectrum. To achieve this, those ion signals whose measured values display saturation of the analog-to-digital converter (ADC) are replaced by correction values, particularly if several successive measured values are in saturation. The correction values are obtained from the width of the signals, preferably simply from the number of measured values in saturation.

14 Claims, 3 Drawing Sheets

SATURATION CORRECTION FOR ION SIGNALS IN TIME-OF-FLIGHT MASS SPECTROMETERS

PRIORITY INFORMATION

This patent application is a continuation of the non-provisional U.S. patent application Ser. No. 13/049,939 filed on Mar. 17, 2011, which claims priority from German Patent Application 10 2010 011 974.1 filed on Mar. 19, 2010. Both the U.S. parent application and the German priority application are hereby incorporated by reference.

FIELD OF THE INVENTION

The invention relates to time-of-flight mass spectrometers in which individual time-of-flight spectra are measured by detection systems with limited dynamic measurement range and are summed to sum spectra.

BACKGROUND OF THE INVENTION

Time-of-flight mass spectrometers acquire individual time-of-flight spectra in rapid succession. To avoid saturation effects for the most intense ion signals, the spectra must each only contain a maximum of a few hundred ions, and therefore they have a large number of empty gaps and a strong variance. For ion signals of low intensity an ion is measured only in one in ten, one in a hundred or even one in a thousand single time-of-flight spectra. Thousands of these individual time-of-flight spectra, which are acquired with very high scanning rates of up to ten thousand spectra per second and more, are then immediately processed into a sum spectrum in order to obtain useful time-of-flight spectra with signals which are true to concentration across a large measurement range for the ion species of the different substances under analysis.

The term "ion signal" is used here to mean that part of an ion current curve which contains ions of one charge-related mass m/z. This ion signal is also called "ion peak".

To measure the time-of-flight spectra, the ion currents are first amplified by secondary electron multipliers (SEM) by a factor of between $10^5$ and $10^7$, and then sampled by special digitization units, which are called "transient recorders". These incorporate very fast analog-to-digital converters (ADC) which today operate with sampling rates of around 4 gigasamples per second (GS/s); higher sampling rates of up to around 10 gigasamples per second are currently under development. The digitization depth per measurement is usually only eight bit, i.e. it spans only values from 0 to 255; a good dynamic range of measurement of five to six orders of magnitude can therefore be achieved only by the summation of hundreds or thousands of individual spectra.

On the one hand, a limited ion current is required so as not to saturate the analog-to-digital converter in the individual time-of-flight spectra. But, on the other hand, every individual analyte ion is required to be measured reliably. In order not to lose any ions nor reach saturation during the measurement, the amplification of the SEM must be set very accurately. Methods for optimally setting the amplification of the SEMs are known (see A. Holle, DE 10 2008 010 118 A1; GB 2 457 559 A; US 2009/0206247 A1, for example). The Poisson distribution of the secondary electrons formed by an impacting ion means it is advantageous if an individual ion produces a signal which generates a measured value of at least 2 to 3 counts in the ADC. However, this limits the intensity dynamics in an individual time-of-flight spectrum to two orders of magnitude: from around 2.5 counts to 255 counts.

Since there exists an electrical noise of up to three counts, the dynamic measuring range is even smaller: only one and a half orders of magnitude.

This optimum setting of the secondary electron multiplier only applies to ions of a selected charge-related mass m/z, however, because the sensitivity of the SEM is dependent on mass and decreases roughly with $1/\sqrt{(m/z)}$. If, for example, the amplification of an SEM is set so that the above-mentioned 2 to 3 counts are achieved for an ion of the charge-related mass m/z=5,000 daltons in order not to lose any ions of high mass, in particular, this means that an ion of mass m/z=50 daltons already results in around 25 counts, and the measurement range for ions of this mass is limited to only one order of magnitude from 25 to 255 counts. Taking the electric noise into account, there remains a dynamic range of only half an order of magnitude.

Until a few years ago this limitation was not such a problem, because the best ion sources supplied only limited quantities of ions per unit of time, and the transmission of the best mass spectrometers was still so low that saturation of the ADC could hardly be reached. This applied both to ion sources with ionization by electrospray ionization (ESI) and also to ionization by matrix-assisted laser desorption (MALDI). Saturation is, in fact, only achieved if there are a few hundred ions in an ion signal of one mass because, as is explained below, this signal is distributed over some eight measurement periods at least, where each has 0.25 nanoseconds duration. However, 800 singly-charged ions per nanosecond correspond to an ion current of around 5 nanoamperes, quite a high ion current for the mass spectrometry of macromolecular substances. The ongoing development of ion sources and also mass spectrometers, however, means the saturation limit is being reached and exceeded more and more often; one therefore has to look for methods which make it possible to approach the saturation limit or even exceed it several times over.

In mass spectrometers of this type, secondary electron multipliers (SEM) are used without exception to measure the ion currents. These can be constructed in various ways; the specialist is familiar with these detectors, however, so that it is not necessary to explain them in more detail here. The process of avalanche-type secondary electron multiplication results in amplification, but also broadening, of the electron current signal. From a single impacting ion, the best secondary electron multipliers generate a signal of around 0.5 nanoseconds full-width at half maximum; the signal width of less expensive secondary electron multipliers is around 1 to 2 nanoseconds. It is not to be expected that significant progress will be made here in the future because the technology is essentially fully developed.

If one samples the electron current curve from the SEMs point by point, by means of a transient recorder with 8 gigasamples per second, for example, one obtains minimum signal widths at half height of 0.5 nanoseconds for each individual ion, regardless of the mass of the ion, if one uses the best devices. If the signal profiles of individual ions are summed in successive individual time-of-flight spectra, or if there are several ions of the same mass in an individual time-of-flight spectrum, the signal widths are even larger. This is because focusing errors of the mass spectrometers, not fully compensated effects of initial energy distributions of the ions before their acceleration into the flight path, and other influences also play a part. These effects result in additional signal broadenings in the order of at least one nanosecond, usually dependent on the mass of the ions. Since in our experience all these contributions add to the signal width in a Pythagorean way (i.e. they form the root of the added squares of the widths), only signal widths of around one nanosecond, at the minimum, can be achieved with the very best spectrometers and detectors; in reality, the signal widths are usually in the range of 2 to 3 nanoseconds. Their full-width at half maximum is almost constant in the lower mass range, where the avalanche width of the SEM dominates; in the upper mass range, on the other hand, it is roughly proportional to the square root of the charge-related mass m/z.

These unavoidable signal widths of the ion signals limit the resolution of the time-of-flight mass spectrometers. The generation of longer times of flight by means of lower accelerating voltages offers a remedy, but has other disadvantages. It is better to use longer flight paths by means of longer flight tubes, although this solution is not very elegant, either. The use of multiply bent flight paths with several reflectors to generate extremely good resolutions has not proven to be a good solution. However, a tried and tested method is an artificial increase of the time of flight resolution and mass resolution by computational means.

Such a computational improvement of the mass resolution can take the following form: a signal analysis is carried out for each individual time-of-flight spectrum. If an ion signal is found, a value which is proportional in terms of area or height is added only where the time of flight of the signal maximum is located. In the simplest case only the measured value of the signal maximum is added at the relevant position of the signal maximum in the individual time-of-flight spectrum. Since the times of flight of the signal maximum are subject to statistical variations, a somewhat broader sum signal results for this ion signal. The sum signal has a finite width but is narrower than when all the measured values were summed. This sum signal only contains the statistical variances, and no longer contains the avalanche width or the width of the imaging errors (see O. Raether: DE 102 06 173 B4; GB 2 390 936 B; U.S. Pat. No. 6,870,156 B2). These conditional additions are not easy to carry out, however, because the complete algorithm must run at four or even eight gigahertz, which is very difficult even when using very fast FPGA (field programmable gate arrays) or very fast digital signal processors (DSP).

It is remarkable that this method not only increases the mass resolution, but also the mass accuracy. Adding together thousands of individual time-of-flight spectra produces a sum time-of-flight spectrum, which is simply called "time-of-flight spectrum" below. Mass spectra are computed from these time-of-flight spectra. The purpose of these time-of-flight mass spectrometers is to determine the masses of the individual ionic species as accurately as possible. The computational measure just described, which was actually introduced to increase the mass resolution, enables mass accuracies of 0.5 ppm or better to be achieved in suitably designed mass spectrometers nowadays.

The term "ppm" (parts per million) for the accuracy is used to mean the relative accuracy of the mass determination in millionths of the charge-related mass m/z. The accuracy is, in turn, set statistically as sigma, the width parameter of the measurement variance, with the implicit assumption of a normal distribution. This width parameter gives the distance between the point of inflection and the maximum of the Gaussian normal distribution curve. The following then applies by definition: if the mass determination is repeated many times, 68% of the values are within the single sigma interval on both sides (i.e. between the points of inflection), 95.57% in twice the sigma interval, 99.74% in three times the sigma interval and 99.9936% in four times the sigma interval of the normally distributed error spread curve. Unfortunately, this method of increasing the mass resolution and the mass accuracy does not increase the dynamic measurement range. One still has to take care not to drive the ion signals into saturation.

SUMMARY OF THE INVENTION

The invention is based on the fact that with modern ion sources and time-of-flight spectrometers it is possible to feed such large ion currents to the measurement system that the measurement device can be driven into saturation. The invention provides a method to increase the dynamic measurement range of the spectrum acquisition process under these conditions by replacing measured values of the analog-to-digital converter (ADC) which are in saturation by correction values before the summation to a sum time-of-flight spectrum is performed. The correction values are derived from the width of the signals, preferably simply from the number of measured values in saturation.

In a particularly simple and thus preferred embodiment, a corrected value can simply be added at the time-of-flight position which corresponds to the center of the sequence of measured values in saturation. This corrected value corresponds to a statistically averaged true maximum measurement value at a given saturation width, and is taken from a table. The value in the table depends on the number of measured values in saturation and may additionally depend on the time of flight.

The values in the table can be obtained from calibration measurements. The isotope patterns of organic substances are especially suitable for this, because the high-intensity ion signals in saturation, which are not directly measurable, can be calculated from these substances' low-intensity isotope signals, which are still in the unsaturated measurement range. It is then possible to determine the statistical relationships between the true intensity maximum and the number of adjoining measured values in saturation. The correction values can, however, also be calculated from accurate measurements of the signal shape in that part of the signal which is not in saturation.

These and other objects, features and advantages of the present invention will become more apparent in light of the following detailed description of preferred embodiments thereof, as illustrated in the accompanying figures.

DETAILED DESCRIPTION OF THE INVENTION

As already briefly described above, the invention provides a method to increase the dynamic measurement range for the spectrum acquisition. To achieve this, those ion signals which drive the analog-to-digital converter (ADC) into saturation in an individual time-of-flight spectrum are replaced by correction values, particularly if the saturation values extend over several successive measurements. The corrections are derived from the width of the signals, preferably simply from the number of measured values in saturation. Since the signal forms can change as a function of the mass of the ions, the correction values can additionally depend on the time of flight. The correction values can be stored in a table, ordered according to signal widths and time-of-flight ranges, for example. The table values are obtained from large numbers of calibration measurements or calculated using the measured or calculated signal shapes for ions of the same mass.

This presupposes that the SEM is adjusted in such a way, as described in the introduction, that a maximum dynamic measurement range is obtained without losing individual ion signals.

In a very simple, but already very effective embodiment, all measured values which are sampled in an ADC at a rate of eight gigasamples per second and with eight bit depth, for example, are investigated immediately as usual in an FPGA or a DSP for the presence of a signal maximum. If a signal maximum is present, the maximum measured value and the corresponding time of flight, which exists as a counting index with at least 24 bit depth, is sent to a special arithmetic unit, which adds the measured value at the position of the time of flight of the signal maximum to a sum spectrum. Since around a million values are measured in an individual time-of-flight spectrum, but there are at most only a few thousand ion signals, the special arithmetic unit can also operate more slowly than the FPGA; a simple PC can be used here, for example.

If the search algorithm for signal maxima used in the FPGA determines that the saturation value 255 was transmitted by the ADC, the counting of the measured values in saturation begins. As soon as a measured value is no longer in saturation, the FPGA sends the time-of-flight index together with the number of measured values in saturation to the special arithmetic unit. The special arithmetic unit takes a corrected measurement value from a table, which is structured according to the number of the saturated measured values and the time-of-flight ranges, and adds it to the sum spectrum, at the position of the time of flight which corresponds to the center of the saturation range.

Figure 1:
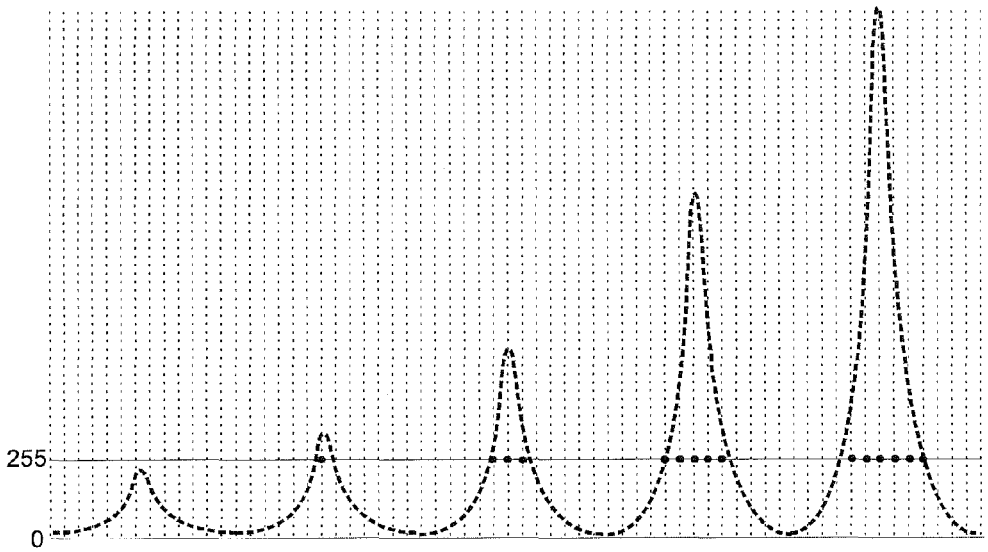
FIG. 1 illustrates the statistical relationship between the true maximum of the ion signals beyond the saturation value of 255 and the number of measurements in saturation (black dots).
Figure 2:
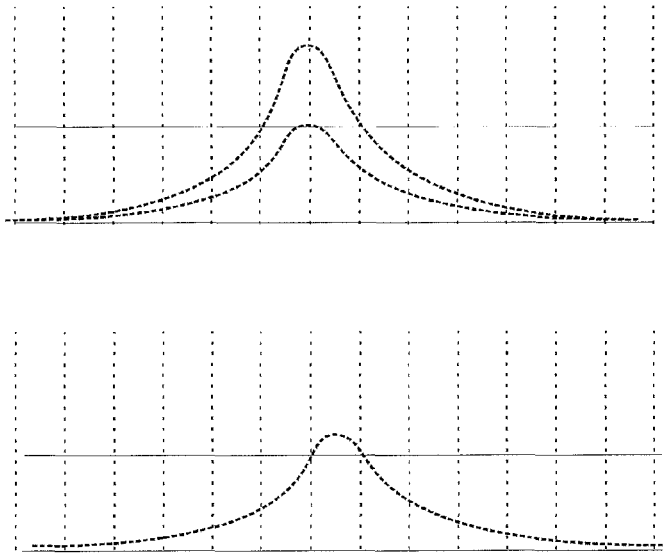
FIG. 2 demonstrates that there is a wide range for the signal strengths before one measured value in saturation becomes a sequence of two measured values in saturation. An approximate correction of the signal overshoots can only be achieved by means of a large number of corrections for ion signals of the same mass.
Figure 3:
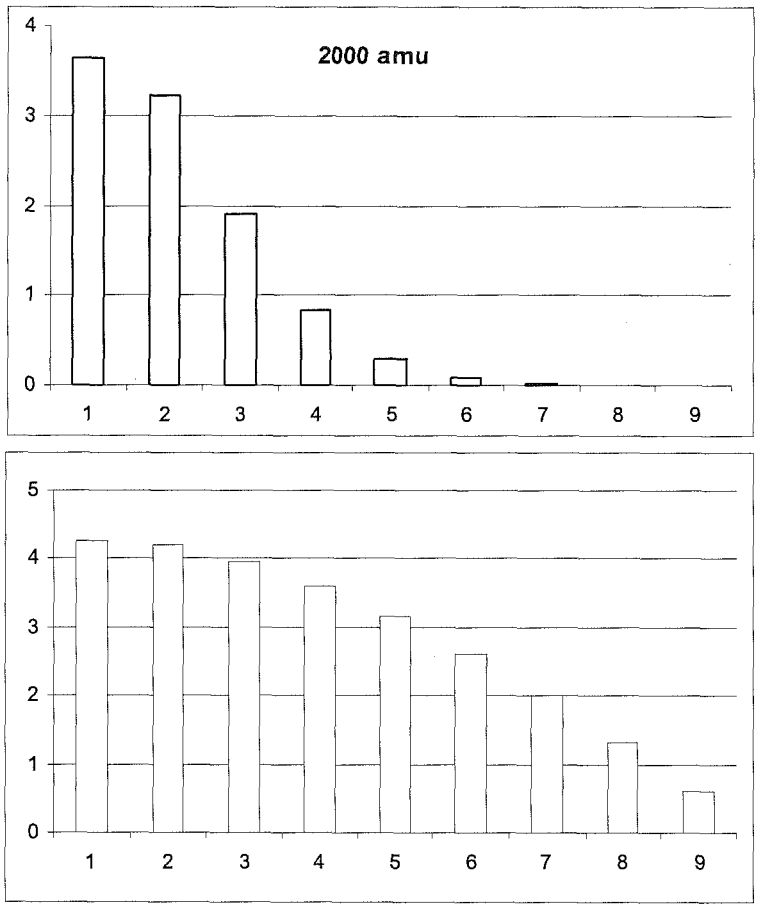
FIG. 3 presents the calculated isotope group of signals for a peptide with mass 2000 atomic mass units. In the upper diagram, the intensities are displayed in a linear mode, in the bottom diagram, they are displayed logarithmically. If, for instance, the signals 1, 2, 3, and 4 are saturated in a measured spectrum, their true height can be calculated from the signals 5, 6, 7, and 8.

The table values for the corrections can be obtained by statistical averages from large numbers of calibration measurements. For these calibration measurements it is necessary to know the true signal intensities at the positions of saturation. Particularly suitable for this purpose are the isotope patterns of organic substances, which contain signals with widely differing, but known intensities. FIG. 3 shows an example of the isotope pattern of a peptide with mass 2000 atomic mass units. The high-intensity ion signals beyond the saturation limit, which are not directly measurable, can be calculated from low-intensity isotope signals which are still in the unsaturated measurement range. It is then possible to determine the statistical relationships between intensity beyond the saturation and number of successive measured values in saturation. All the measurements are carried out with many individual time-of-flight spectra. Using appropriate substances of different masses, which each supply sufficiently high ion currents, it is also possible to take measurements in different time-of-flight ranges. The calibration measurements can be carried out automatically with suitable programs and provide the above-mentioned tables with correction values as a function of the number of successive measured values in saturation and as a function of the time-of-flight range.

The corrected measured values from the table will not correspond, in individual cases, to the true intensity values of the ion signals; but in the statistical average over thousands of individual spectra, a quite good approximate value results if the method is well calibrated. With this method it is possible to extend the dynamic range of measurement by two orders of magnitude and more, which at the same time also means an increase in ion sensitivity by two orders of magnitude. This sensitivity increase is, of course, primarily brought about by improvement of the ion source and ion transmission in the mass spectrometer; but without the application of this invention, it cannot be exploited with customary detection systems.

The method only works, however, as long as neighboring ion signals do not overlap in the saturation region. This requires the time-of-flight mass spectrometer to have a good mass resolving power itself, i.e. without the computational improvement of the mass resolution. This is usually the case in the lower mass range, where the extension of the dynamic measurement range is particularly desirable.

In addition to this very simple method, which only ever adds one single correction value to the sum spectrum, more complex methods can be used. It is entirely possible to add correction values at the times of flight of all measured values in saturation. These correction values can also be obtained by calibration measurements using isotope patterns and stored in suitable tables. There is then no increase in the mass resolution, but it is possible to obtain more quantitatively accurate measurements.

The development of transient recorders is targeted not only at faster acquisition rates, but also at higher data depths for the analog-to-digital conversion. The aim is to achieve 10 or even 12 bit data depth. Even when these transient recorders are on the market, the problem with saturated measured values will soon reappear as a result of the continued development of ion sources with better yield and mass spectrometers with better transmission. It will then again be possible to replace saturated measurement values by correction values according to this invention.

Figure 4:
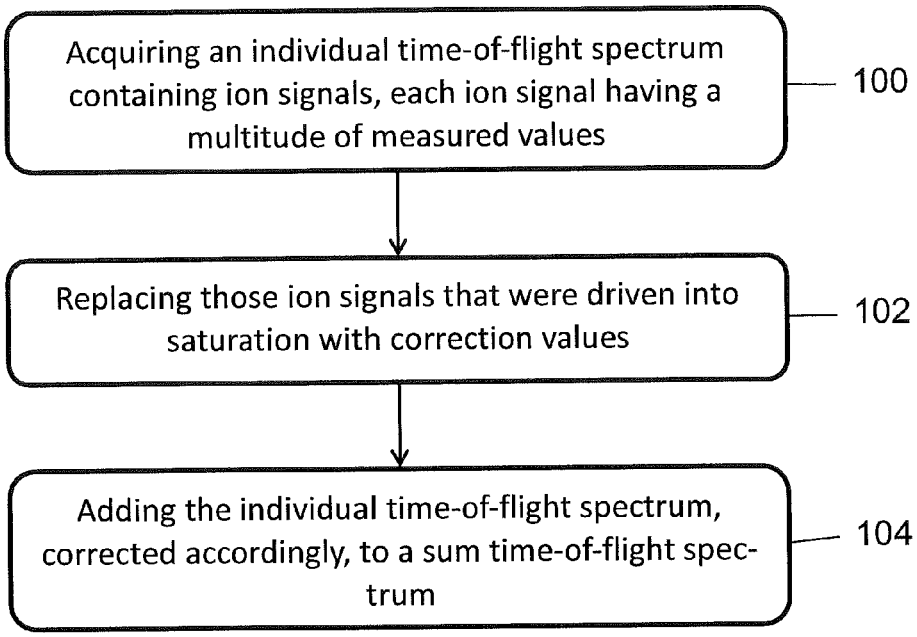
FIG. 4 is a flow diagram that illustrates an exemplary method for increasing a dynamic measurement range of a time-of-flight mass spectrometer.

FIG. 4 illustrates a flow chart of an exemplary method according to the invention. In step 100, an individual time-of-flight spectrum containing ion signals is acquired wherein each ion signal has a multitude of measured values. In step 102, those ion signals that were driven into saturation are replaced with correction values. In step 104, the individual time-of-flight spectrum, now containing measured values and correction values, is added to a sum time-of-flight spectrum.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A method for increasing a dynamic measurement range of a spectrum acquisition of a time-of-flight mass spectrometer, comprising:

acquiring an individual time-of-flight spectrum containing ion signals, each ion signal having a multitude of measured values;

replacing those ion signals that were driven into saturation with correction values, wherein an intensity of the correction values is determined from one of a width of the ion signals in saturation and a number of the measured values at an upper intensity limit of an ion signal in saturation; and adding the individual time-of-flight spectrum, corrected accordingly, to a sum time-of-flight spectrum, wherein for several measured values of an ion signal in saturation a correction value at a single time of flight is added to the sum time-of-flight spectrum.

2. The method according to claim 1, wherein the correction values are provided in a memory device and are ordered according to the number of measured values of an ion signal in saturation.

3. The method according to claim 2, wherein the memory device comprises a table, and the correction values in the table are obtained by calibration measurements of the isotope patterns of substance ions in time-of-flight spectra.

4. The method according to claim 1, wherein for determining the correction values the times of flight of the ions in the ion signal are used additionally.

5. The method according to claim 4, wherein the correction values are provided in a memory device and are ordered according to the number of measured values of an ion signal in saturation and according to time-of-flight ranges.

6. The method according to claim 1, wherein only one correction value at only a single time of flight is added to the sum time-of-flight spectrum.

7. The method according to claim 6, wherein the correction value is added at that time of flight of the sum time-of-flight spectrum which is in the center of a saturation region.

8. A method for increasing a dynamic measurement range of a spectrum acquisition of a time-of-flight mass spectrometer, comprising:

acquiring an individual time-of-flight spectrum containing ion signals, each ion signal having a multitude of measured values;

replacing those ion signals that were driven into saturation with correction values, wherein an intensity of the correction values is calculated from a signal shape in a part of an ion signal in saturation, which is not at an upper intensity limit, in the same individual time-of-flight spectrum; and adding the individual time-of-flight spectrum, corrected accordingly, to a sum time-of-flight spectrum, wherein for several measured values of an ion signal in saturation a correction value at a single time of flight is added to the sum time-of-flight spectrum.

9. The method according to claim 8, wherein the correction values are provided in a memory device and are ordered according to the number of measured values of an ion signal in saturation.

10. The method according to claim 9, wherein the memory device comprises a table, and the correction values in the table are obtained by calibration measurements of the isotope patterns of substance ions in time-of-flight spectra.

11. The method according to claim 8, wherein for determining the correction values the times of flight of the ions in the ion signal are used additionally.

12. The method according to claim 11, wherein the correction values are provided in a memory device and are ordered according to the number of measured values of an ion signal in saturation and according to time-of-flight ranges.

13. The method according to claim 8, wherein only one correction value at only a single time of flight is added to the sum time-of-flight spectrum.

14. The method according to claim 13, wherein the correction value is added at that time of flight of the sum time-of-flight spectrum which is in the center of a saturation region.

* * * * *